US009815592B2

(12) United States Patent
Diaz

(10) Patent No.: US 9,815,592 B2
(45) **Date of Patent: *Nov. 14, 2017**

(54) LEAK-FREE AIRLESS CONTAINER HAVING PISTON DEVICE

(71) Applicant: Priska I. Diaz, Eastchester, NY (US)

(72) Inventor: Priska I. Diaz, Eastchester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/792,994

(22) Filed: Jul. 7, 2015

(65) Prior Publication Data

US 2015/0307231 A1 Oct. 29, 2015

Related U.S. Application Data

(63) Continuation-in-part of application No. 13/987,849, filed on Sep. 9, 2013, now abandoned, which is a continuation-in-part of application No. 13/815,802, filed on Mar. 15, 2013, now Pat. No. 8,875,913, which is a continuation-in-part of application No. 13/066,896, filed on Apr. 28, 2011, now abandoned.

(60) Provisional application No. 61/351,190, filed on Jun. 3, 2010.

(51) Int. Cl.

| | |
|---|---|
| ***A61J 11/04*** | (2006.01) |
| ***B65D 21/08*** | (2006.01) |
| ***B65D 6/00*** | (2006.01) |
| ***A61J 9/00*** | (2006.01) |

(52) U.S. Cl.

CPC ..... *B65D 21/086* (2013.01); *A61J 9/003* (2013.01); *A61J 11/04* (2013.01); *B65D 11/00* (2013.01)

(58) Field of Classification Search

CPC ..... A61J 11/04; A61J 9/003; B65D 21/086
USPC ..... 215/11.1, 11, 4, 6, 11.4–11.6; 222/249, 222/386

See application file for complete search history.

(56) References Cited

U.S. PATENT DOCUMENTS

| | | | | |
|---|---|---|---|---|
| 238,995 | A * | 3/1881 | Van Syckel | A61J 11/008 215/11.1 |
| 2,898,007 | A | 8/1959 | Gassaway | |
| 3,184,120 | A | 5/1965 | Undi | |
| 3,727,971 | A | 4/1973 | Sisler | |
| 4,010,861 | A | 3/1977 | Welten | |
| 4,197,967 | A * | 4/1980 | Baur | B05C 17/00576 222/190 |
| 5,109,996 | A | 5/1992 | Sullivan | |
| 6,138,848 | A | 10/2000 | Fermo | |
| 6,598,766 | B1 * | 7/2003 | Brugner | B05C 17/00576 222/326 |
| 6,871,751 | B2 | 3/2005 | Kerns et al. | |
| 7,810,661 | B2 | 10/2010 | Murphy | |
| 8,608,686 | B2 * | 12/2013 | Tennican | A61M 5/31596 604/89 |

(Continued)

*Primary Examiner* — Sue A Weaver
(74) *Attorney, Agent, or Firm* — The Law Firm of Andrea Hence Evans, LLC

(57) ABSTRACT

An airless container includes: an elongated shaft having an open top and an open bottom and having a constant internal cross-section, and having attachment means for securing a fastening collar thereto; a fastening collar; a liquid outlet piece; a piston to sealably and moveably fit within the elongated shaft, the piston having external sides with a peripheral upper blade and a peripheral lower blade, each of said peripheral upper blade peripheral lower blade having a plurality of peripheral ridges running perpendicular to the elongated shaft elongation direction.

12 Claims, 12 Drawing Sheets

(56) References Cited

U.S. PATENT DOCUMENTS

| | | | | |
|---|---|---|---|---|
| 8,875,913 | B2 * | 11/2014 | Diaz | A61J 9/005 215/11.1 |
| 2010/0147896 | A1 * | 6/2010 | Obrist | B05C 17/00576 222/327 |
| 2012/0065608 | A1 * | 3/2012 | Costello | A61J 9/00 604/403 |

* cited by examiner

LEAK-FREE AIRLESS CONTAINER HAVING PISTON DEVICE

REFERENCE TO RELATED APPLICATIONS

This patent application is a continuation in part application of copending Ser. No. 13/987,849, filed by Priska I. Diaz on Sep. 9, 2013 titled "Lubricious, Sealed, Airless Container", which itself is a continuation-in-part application of copending U.S. patent application Ser. No. 13/815,802, filed by Priska I. Diaz on Mar. 15, 2013 titled "Lubricious, Sealed, Airless Container", which itself is a continuation-in-part application of copending U.S. patent application Ser. No. 13/066,896, filed by Priska I. Diaz on Apr. 28, 2011 titled "Airless Container", which itself is a continuation-in-part of provisional U.S. application Ser. No. 61/351,190 filed on Jun. 3, 2010 and titled "Baby Nurser", by Priska I. Diaz, hereby incorporated by reference.

BACKGROUND OF INVENTION

The invention relates generally to a leak-free, container having a piston device that is directed to accomplish a plurality of preferred goals simultaneously. Specifically, the present invention piston device is directed to: elimination or very significant reduction of air inside the containment area of liquids of different viscosity, such us water, milk, oils, creams, pureed foods, chocolate mousse, yogurts, and the like to keep the contents air-free to prevent spoiling. The piston moves towards a suction force to deliver air-free contents. For example, when this airless container is used as a baby bottle, it very significantly reduces gas-creating air during feeding or drinking; and the accomplishment of the foregoing with minimal, user-friendly components. Preferred embodiments also provide the following additional benefits: 100% air free to help prevent gas and gas associated effects from air ingestion; allows user to expel air by pushing the piston from the bottom up; helps retard oxidation to retain nutrients that are lost when the bottle's contents comes in contact with air; and works on suction as opposed to gravity, so the user can feed in any angle. Further, there are included herein unique component features and materials of construction that create leak proof connections and functionality of the present invention devices. The container and piston device work on suction as opposed to gravity, so the user can dispense by a pump or spray or directly suck to ingest the contents in any angle.

SUMMARY OF INVENTION

The present invention is directed a leak-free, container and piston device—having a container with an elongated shaft having at least one side wall, an open top and an open bottom and having a constant internal cross-section from a top view, the open top having attachment means for securing a fastening collar thereto; a fastening collar being removably attachable to the open top of the elongated shaft and having a central orifice for holding a liquid outlet, wherein the liquid outlet may be a straw, nipple, mechanical or electrical pump or other known pieces that allow the contents of the container to be received by the user through the piece; the fastening collar is situated on the elongated tube open top and the fastening collar is placed over it and fastened to the attachment means of the elongated tube open top, a liquid impermeable seal is established; a piston having top view footprint outer perimeter consistent with the elongated shaft internal cross-section so as to sealably and moveably fit within the open bottom of the elongated shaft. The piston has external sides with a peripheral upper blade and a peripheral lower blade, both the peripheral upper blade and peripheral lower blade have a plurality of peripheral ridges or blades running perpendicular to the elongated shaft elongation direction. The blades reduce the contact surface area as the piston moves.

With this container, a user may place the piston (which acts as an air plug) in position from the bottom of the shaft; fill the shaft with liquid contents; place the fastening collar and securely attach it to the shaft neck; and then push the piston from bottom up to expel extra air so as to eliminate all air inside the shaft, and to provide a dispensing capability wherein said piston shall move upwardly through suction caused by a suction force at said liquid outlet. When the user forms a closed seal onto the liquid outlet and provides a suction force through the liquid outlet, the contents are dispensed freely. Thus, liquid food is dispensed through more than one orifice and only upon suction. The suction strength controls the flow rate. The tip of liquid outlet extends inside user's mouth upon suction just like a mother's breast, for example. In some preferred embodiments of the present invention airless container, the constant internal cross-section of the elongated shaft is circular. In other embodiments, the cross-section could be other than circular, such as oval, square, polygonal or even irregular, in which case, the attachment mechanism could be snap on or other mechanism rather than a screw-on. In some preferred embodiments of the present invention airless container, the liquid outlet includes a central liquid-release orifice and a plurality of non-central liquid-release orifices. In some preferred embodiments of the present invention airless container, the liquid outlet and the liquid outlet fastening collar are removably attachable separate components. In yet other embodiments, the liquid outlet and the liquid outlet fastening collar are permanently attached to one another.

In some preferred embodiments of the present invention airless container, the liquid outlet is a stretchable nipple, straw and the like that will move away from said liquid outlet fastening collar upon suction force of at least twenty five mm Hg. A human being, animal, pump or machine may create suction.

In some preferred embodiments of the present invention airless container, the liquid outlet is selected from the group consisting of silicone, latex, elastomer and combinations thereof. In some preferred embodiments, the liquid outlet lines the inside of the attachment collar so that liquid or contents in the container never touches the material of the collar, e.g., plastic.

In some preferred embodiments of the present invention airless container, the piston external blades are composed of a material that includes a blend of an elastomer, polypropylene and a siloxane.

In some preferred embodiments of the present invention airless container, the piston has at least two external blades that have at least three ridges on each blade.

In some preferred embodiments of the present invention airless container, the shaft includes an elastomeric grip component at its bottom.

In some preferred embodiments of the present invention airless container, the bottle includes: An airless container, which comprises: a) a container elongated shaft having at least one side wall, an open top and an open bottom and having a constant internal cross-section from a top view, the open top having attachment means for securing a liquid outlet piece fastening collar thereto; b) a liquid outlet connected to the open top of the container elongated shaft, the liquid outlet selected from the group consisting of a spout, a push-pull outlet, tube and the like; and c) a piston having top view footprint outer perimeter consistent with the elongated shaft internal cross-section so as to sealably and moveably fit within the open bottom of the elongated shaft, the piston having external sides with a peripheral upper blade and a peripheral lower blade, each of the peripheral upper blade peripheral lower blade having a plurality of peripheral ridges running perpendicular to the elongated shaft elongation direction; wherein a user may place the piston in position from the bottom of the shaft; fill the shaft with liquid food; place the liquid outlet and securely attach it to the shaft; and then push the piston from bottom up to expel extra air so as to eliminate all air inside the shaft, and to provide a feeding capability wherein the piston shall move upwardly through suction caused by a suction force at the liquid outlet.

In some preferred embodiments of the present invention airless container, the liquid outlet is a spout, valve, straw and the like.

In some preferred embodiments of the present invention airless container, the liquid outlet is a polypropylene spout.

In some preferred embodiments of the present invention airless container, the liquid outlet is a push-pull outlet.

For any embodiment of the present invention, other detailed, useful features may be included. These would include pulls inside and/or outside the pistons to enhance ease of removal; and a burping mechanism, such as an air release valve, for the piston to allow initial air between the filled liquid and the piston to escape during initial set up and prior to a user's use (this closes the gap between the liquid and the piston or the liquid and the end opposite the piston to further make the bottle airless during use). Burping valves, also known as air release valves, allow air to escape, but not liquids.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
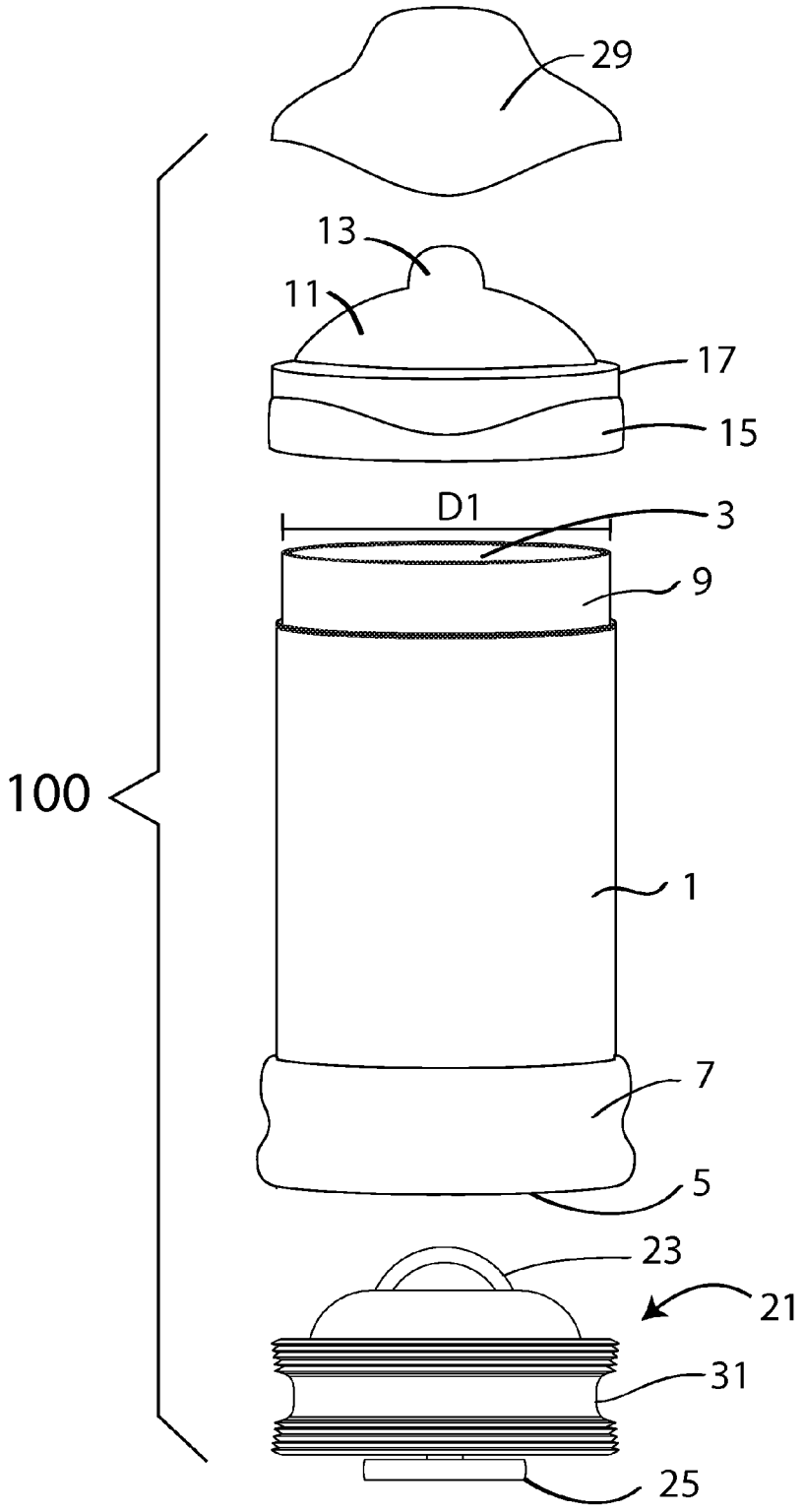
FIG. 1 illustrates front, perspective exploded view of one embodiment of the present invention airless container having a handle on the piston.

Referring now in detail to the drawings wherein like reference numerals designate corresponding parts throughout the several views, various embodiments of the present invention are shown.

The plunger or piston on the present invention airless container has piston external sides with a peripheral upper blade and a peripheral lower blade, each of the peripheral upper blade and the peripheral lower blade having a plurality of peripheral ridges running perpendicular to the elongated shaft elongation direction, i.e. the piston has two opposing blades that each have multiple ridges. These blades and their ridges move up and down the inside of the bottle main elongated shaft to create a super seal to prevent leakage during use. Further, in most preferred embodiments, the blades are constructed of FDA approved silicone, elastomers, foam or polyurethane. In some preferred embodiments, the blades are constructed of a unique formulated blend of polypropylene materials to be both structural and flexible to create ideal watertight seal and yet slippery enough to easily overcome friction created by seal.

FIG. 1 illustrates front, perspective exploded view of one embodiment of the present invention airless container 100. Container 100 includes a main elongated shaft 1. Shaft 1 is circular in this embodiment but may have a different internal and/or external shape, such as an oval, a square with rounded corners, or other configuration, e.g., any polygon. The shaft 1 may be made of any functional material but it is preferably clear or translucent, at least in part, so that liquid level may be easily discerned. Shaft 1 may be made of glass or plastic and plastic such as polyethylene, polypropylene, or nylon may be used. Elongated shaft 1 has an open top 3 and an open bottom 5. It has an internal cross section that is constant (except for a small, slightly widened bottom piston entry portion). The shaft 1 has an attachment means at its open top 3. The attachment means may be a threaded area, a snap on receiver or other attachment means. In this embodiment, shaft 1 has a recessed external area 9 for force fit of a fastening collar. Shaft 1 also has an optional but preferred grip component 7 at its bottom 5. This grip component 7 is preferably an elastomeric grip component.

A fastening collar 17 is adapted to fit over and secure a liquid outlet piece 11. The liquid outlet piece has an opening sized to receive the liquid inside of the container. When a seal is formed on the outlet and suction is applied, the liquid will freely dispense from the container. Fastening collar 17 is then fitted on to recessed external area 9. Liquid outlet piece 11 may have an outer rim that is vertical or horizontal. Liquid outlet piece 11 may be a conventional nipple or one that simulates a real woman's breast nipple that enable nipple 13 to stretch and release milk or other liquid when the baby is sucking on it. In this embodiment, the nipple piece 11 and the nipple piece-fastening collar 17 are preferably permanently connected to one another, but alternatively could be removably connectable. An optional protective cap 29 is also shown and is used to protect the nipple when not in use. Liquid outlet piece may be a straw, tube, manual or electric pump or any vessel sized to receive the liquid from the container.

Figure 8:
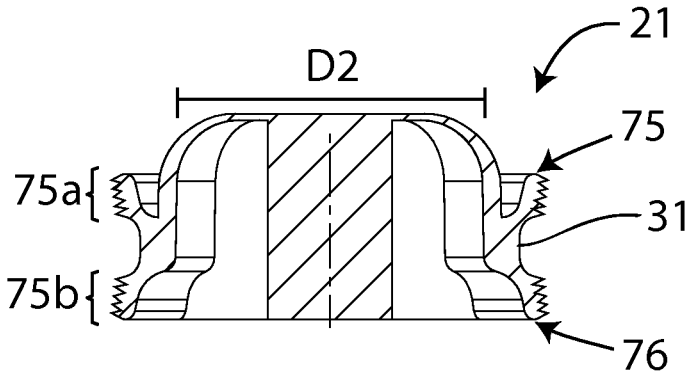
FIG. 8 illustrates the cut view piston of the present invention.
Figure 12:
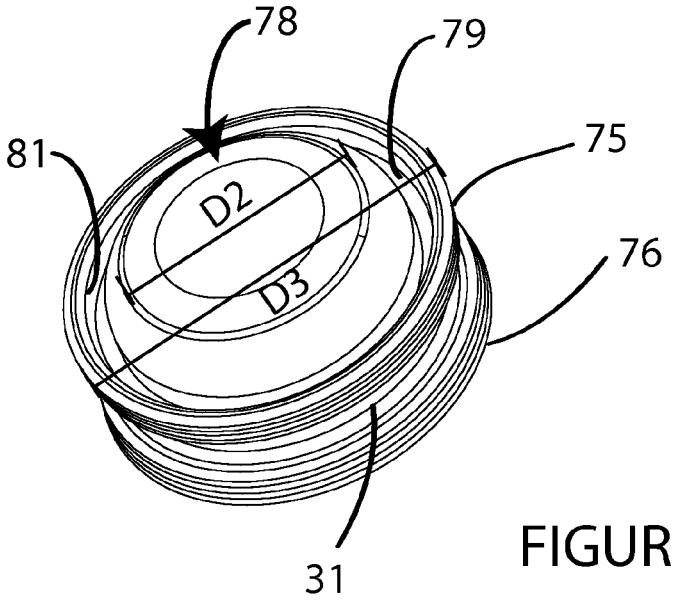
FIG. 12 is a top perspective view of the piston.
Figure 14:
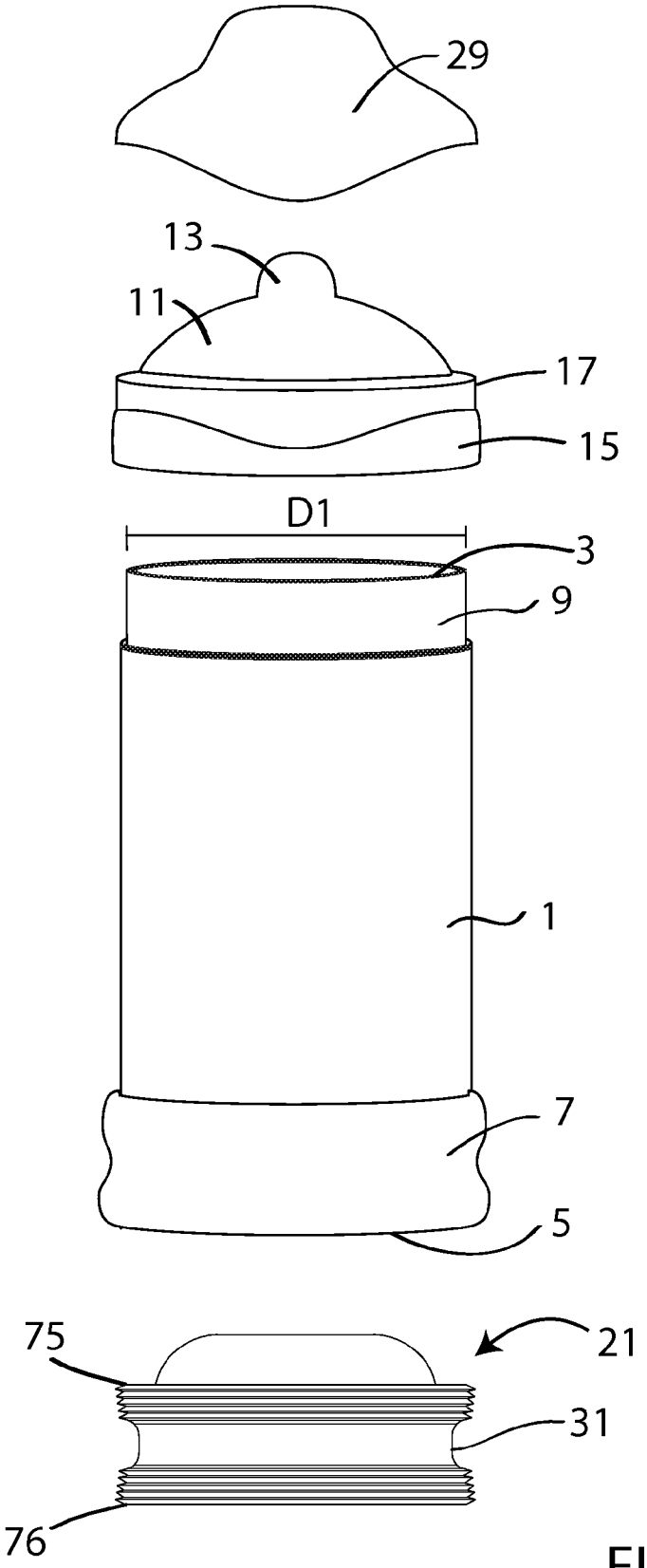
FIG. 14 illustrates a front, perspective exploded view of one embodiment of the present invention airless container with liquid outlet and with the piston of the present invention.

FIG. 8 illustrates the cut view piston of the present invention. Piston 21 is a disk adapted to fit into shaft 1. It includes a sealing ring 31 that may be made of a silicone or other effective material to enhance the sealing yet permit sliding, as described below, but silicone is a preferred material of construction, at least at the contact surfaces. Alternatively or additionally, the piston 21 is preferably made of nylon and can be internally or completely coated, molded or co-molded, with silicone. Piston 21 has optional pull rings or handles 23 and 25, as shown in FIG. 1, for pulling it up through shaft 1 or down through shaft 1 when disassembling for cleaning, as well as to distort it or alternatively, to temporarily open an air release valve, to effect a burping air removal so that the piston comes into direct contact with the contents before it is used. In addition to the features enumerated on piston 21, the sealing ring 31 has upper 75 and lower blades 76 with plural sealing ridges 75*a* and 75*b*, respectively. As shown in FIG. 14, The sealing ring 31 is the indented area on the piston between upper and lower blades 75, 76. The sealing ring's diameter is substantially equal to the top side 78 diameter, D2. The sealing ring 31 is not flexible and never touches the internal walls of the container. As shown in FIG. 12, D3 is larger than D2 so that the peripheral blades make contact with the internal walls of the container while the sealing ring 31 provides additional support for the blades as they move through the bottle. The top 78 of the piston may be an alternate shape such as a square, octagon or any polygon so long as the upper and lower peripheral blades make contact with the internal walls of the bottle.

FIG. 12 is a top perspective view of the piston.

Figure 9:
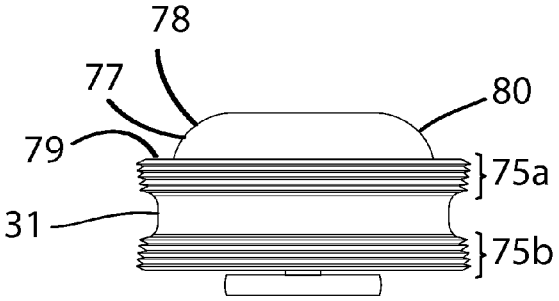
FIG. 9 illustrates a perspective view of the piston of the present invention.

In the present invention, the shaft 1 has a circular circumference having a diameter D1, shown in FIG. 14. As discussed above, the shape of the shaft 1 may vary and be any known shape of a container to support liquids or foods. The piston 21 shape should mirror the shape of the shaft to create a water tight and air tight system. FIG. 9 illustrates a perspective view of the piston of the present invention. Piston 21 comprises a body 77. The body 77 features a curved top side 78; however a flat top side may be used. The curved top side 78 forms an indentation 79 or sunken in effect between the outer wall 80 of the piston and the inner wall 81 of the upper blade 75. In use, the liquid or food in the shaft contacts the top surface 78 of the piston and can collect in the indentation 79 or sunken area. The 79 sunken area is needed to make the wall thickness thicker where the blades rest thinner than the rest of the piston, which they need to be in order to be flexible. The curved top side is a dome shape and its diameter D2 is less than the shaft's diameter D1. The upper blades 75 and lower blades 76 form rings around the body of the piston and create an extension such that the diameter D3 of the blades 75, 76 is slightly larger than the diameter of the shaft D1 to seal. The upper blades 75 and lower blades 76 offer stability within the container.

Figure 15:
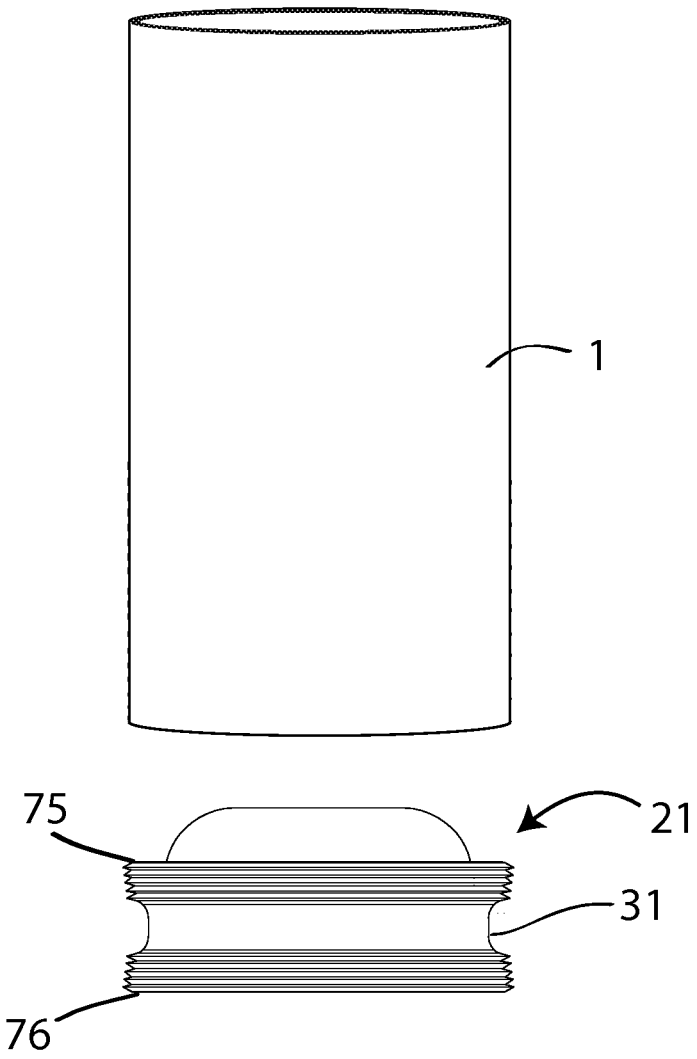
FIG. 15 illustrates a front, perspective exploded view of the one embodiment of the present invention airless container with the piston of the present invention.

FIG. 14 illustrates a front, perspective exploded view of one embodiment of the present invention airless container with liquid outlet and with the piston of the present invention. FIG. 15 illustrates a front, perspective exploded view of the one embodiment of the present invention airless container with the piston of the present invention. With this airless container 100, a user may place the piston 21 (which acts as an air plug) in position from the bottom of the shaft 1; fill the shaft 1 with liquid food; place the liquid outlet piece 11 and collar 17 on, and securely attach it to, the shaft neck; and then push the piston 21 from bottom up, to expel extra air so as to eliminate all air inside the shaft 1, and to provide a feeding capability with a simulation of real woman breast-nipple experience to a baby, if a nipple is used as a liquid piece, wherein the nipple 13 is extended and the piston 21 moves upward toward the top as the baby sucks the liquid. Thus, milk or other liquid food is dispensed in the same manner that breasts do, and, in some preferred embodiments, through more than one angled orifice and only upon suction. The suction strength controls the flow rate. The piston's blades 75, 76 seals the shaft by making the area between the inside walls of the shaft and the blades 75, 76 airtight and watertight. The piston moves in both directions within the container as suction force may be applied inward into the liquid outlet or in an outward direction.

Each blade 75, 76 has a plurality of ridges 75*a*, 75*b* forming angled grooves running perpendicular to the internal elongated side of the container.

Figure 10:
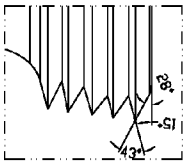
FIG. 10 is an enlarged view of the blades with ridges and grooves shown.
Figure 11A:
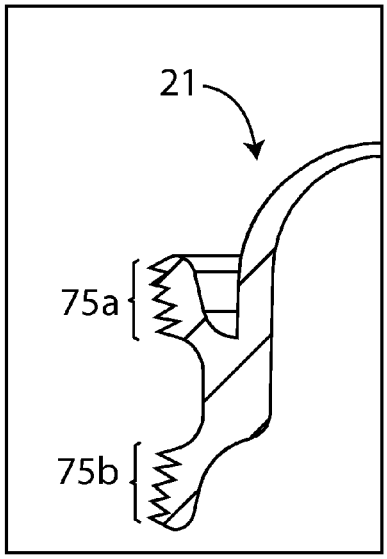
FIG. 11*a* is an illustration of the blades with no internal design.

FIG. 10 is an enlarged view of the blades with ridges and grooves shown. FIG. 10 shows an exploded view of the ridges having an angle ranging from 0°-89°. However, the ridges may be designed so that any variation of angles may be used so long as the blade's ridges provide the sealing function described above. At least two ridges are desired per blade to create the sealing affect. FIG. 11*a* is an illustration of the blades with no internal design. The blades and their ridges are flexible such that the blades can expand and contract as the piston moves throughout the container. The angled grooves provide added flexibility of the blades. Because the size of the containers and their diameters can vary, the piston needs to be flexible yet provide contact with the internal walls of the shaft while maintaining a seal. The grooves' angles may vary slightly to accommodate container variations whereby some of the grooves can be designed to make direct contact with the internal walls constantly and other grooves may be designed to not touch the internal walls of the container until they reach a certain position on the container. For example, some of the ridges are designed to touch the walls of the shaft when they reach the smallest portion of the bottle. This is significant, as some containers may not have a constant diameter and the piston can be designed to accommodate containers of multiple and varying diameters. The blades' ridges can also be straight, wavy, cross-hatched and have varying designs so long as they maintain a sealing affect, as discussed.

Figure 11B:
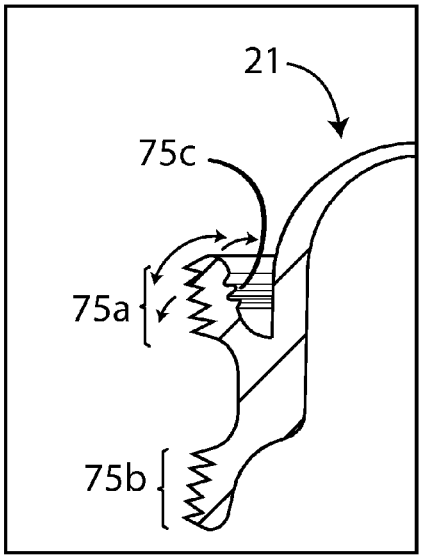
FIG. 11*b* is an illustration of the blades with an internal design.

For more flexibility, the ridges may feature an internal design that allows additional expansion and contraction of the top and bottom blade or first and last blade, if more than two blades are used. The internal design features ridges 75*c* having grooves, as described above on the inside area of the piston between the body 77 and indention 79, as shown in FIG. 11*b*. FIG. 11*b* is an illustration of the blades with an internal design. The internal ridges 75*c* reduce the contact surface area as the piston moves. The internal ridges are on an opposite side from the external ridges and in an angled direction away from the internal walls of the shaft. The internal ridges help to prevent the piston to rub against the bottle resulting in too much friction and resistance. The internal blades greatly reduce the surface area. They contract and expand because they the profile is substantially angular and triangular where the sharpest angles makes contact with the container. This triangular profile combine with the softened of silicone (or silicone like durometer material) slightly "bends" to fit into smaller areas without greater contact surface. Typically, the molded bottle (or any container) that appears to be a perfect cylinder with constant diameter top to bottom, is really a cone where the top end is smaller and the bottom end. For this reason the piston needs to be able to contract and expand as needed without creating more friction and maintaining a constant seal as the piston moves throughout the container. Both blades should symmetrically contract and expand as they travel through the same space. Optionally, the internal ridges can be added to the bottom blade to accomplish this.

The upper blade 75 moves in the direction of the arrows shown in FIG. 11*b*. The piston can feature various combination of blade designs such as a blades having grooves internally and externally as shown in FIG. 11*b* or blades having grooves externally only, as shown in FIG. 11*a*. Lower blades 76 and their ridges 76*a* feature the same groove and angled design discussed above.

Figure 13:
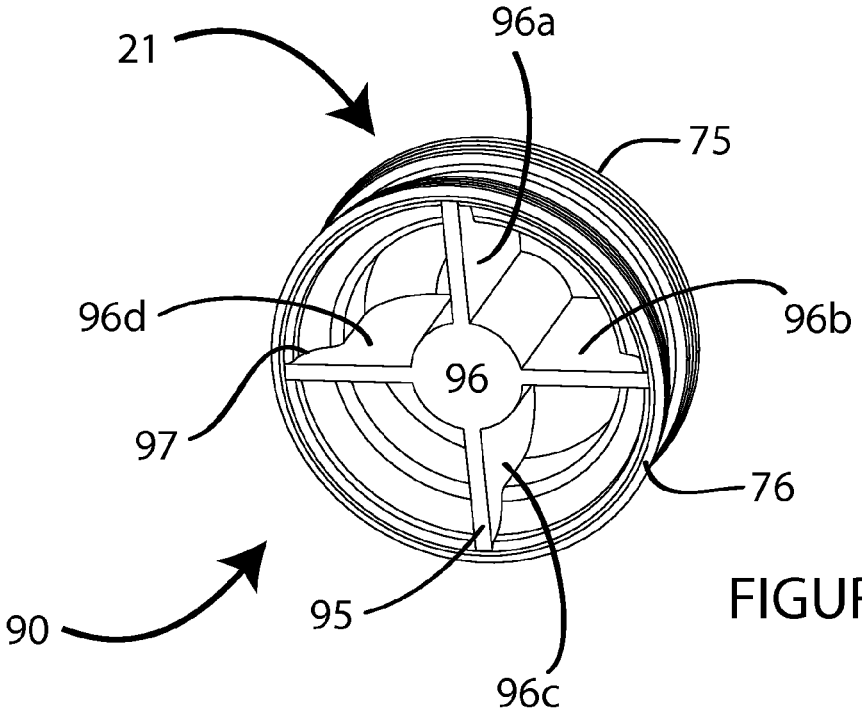
FIG. 13 is a bottom perspective view of the piston.

The top side 78 of the piston 21 has a surface that engages or interacts with the contents of the container. FIG. 13 shows the bottom view of the piston 21. The bottom side 90 of the piston preferably features a bottom piece 95 with a cross shape that gives strength to the flexible body of the piston. The bottom piece is rigid and features a solid cylindrical member 96 centered on the bottom side of the piston. Winged members 96*a*, 96*b*, 96*c*, 96*d* extend from the center member 96 to the bottom inside walls 97 of the piston. The winged members form a cross shape and the area between each wing member is hollow. In use, rather than requiring the piston have a handle, as discussed above, force may be applied directly to the rigid winged members or to the cylindrical member to move the plunger in an upwards direction. In an alternate embodiment of the present invention, the bottom side of the piston may be entirely hollow with no bottom piece. Also, the cross section of the bottom piece is described as a cross shaped; however, multiple shapes and designs may be provided so long as they provide strength to the piston.

The container may be an elongated shaft or sleeve having a number of sides and number of diameters, if circular. The container may be rigid or flexible. The liquid outlet attaches to the top of the container and suction may be created to move the piston in a direction towards the suction force. The shaft may be made of any functional material, as is the case with all of the shafts described herein. The container has an internal cross section that is constant (except for a small, slightly widened bottom piston entry portion).

Figure 2:
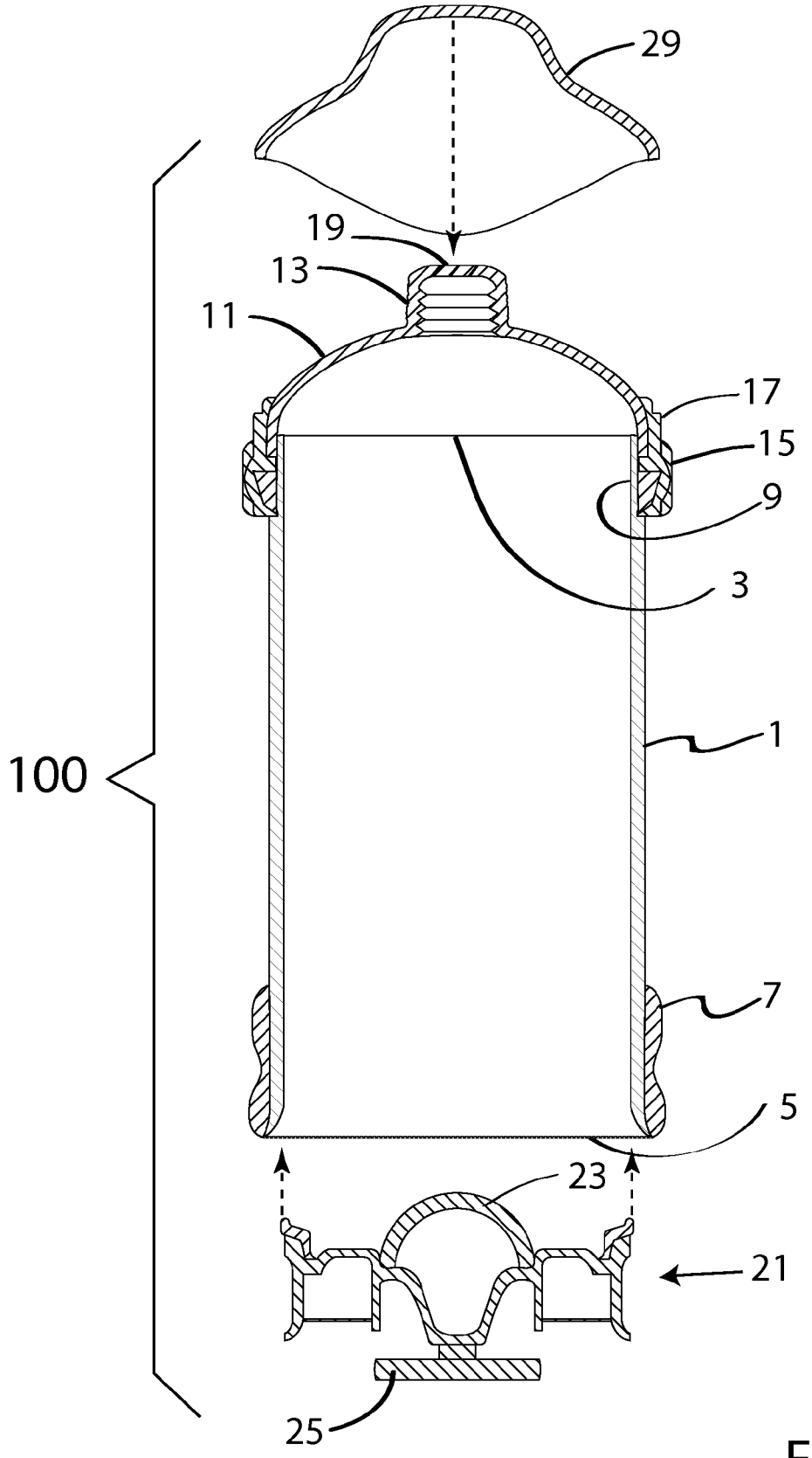
FIG. 2 illustrates an exploded, cut view of the present invention airless container shown in FIG. 1.
Figure 3:
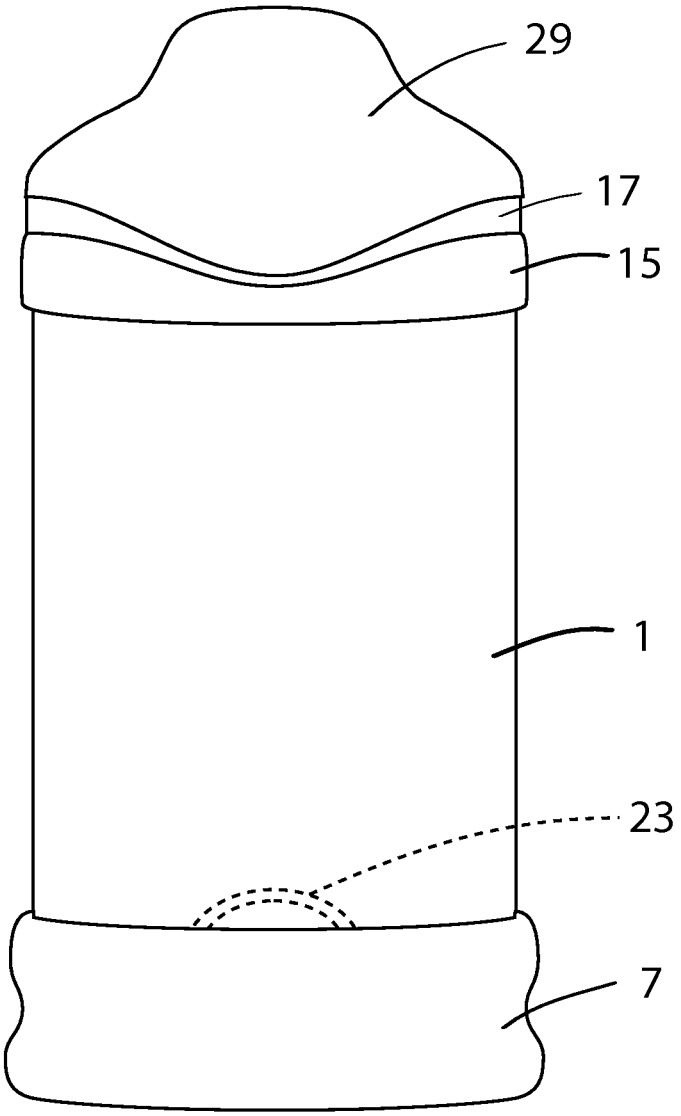
FIG. 3 illustrates a front view of the assembled, capped present invention airless container shown in FIGS. 1 and 2.
Figure 4:
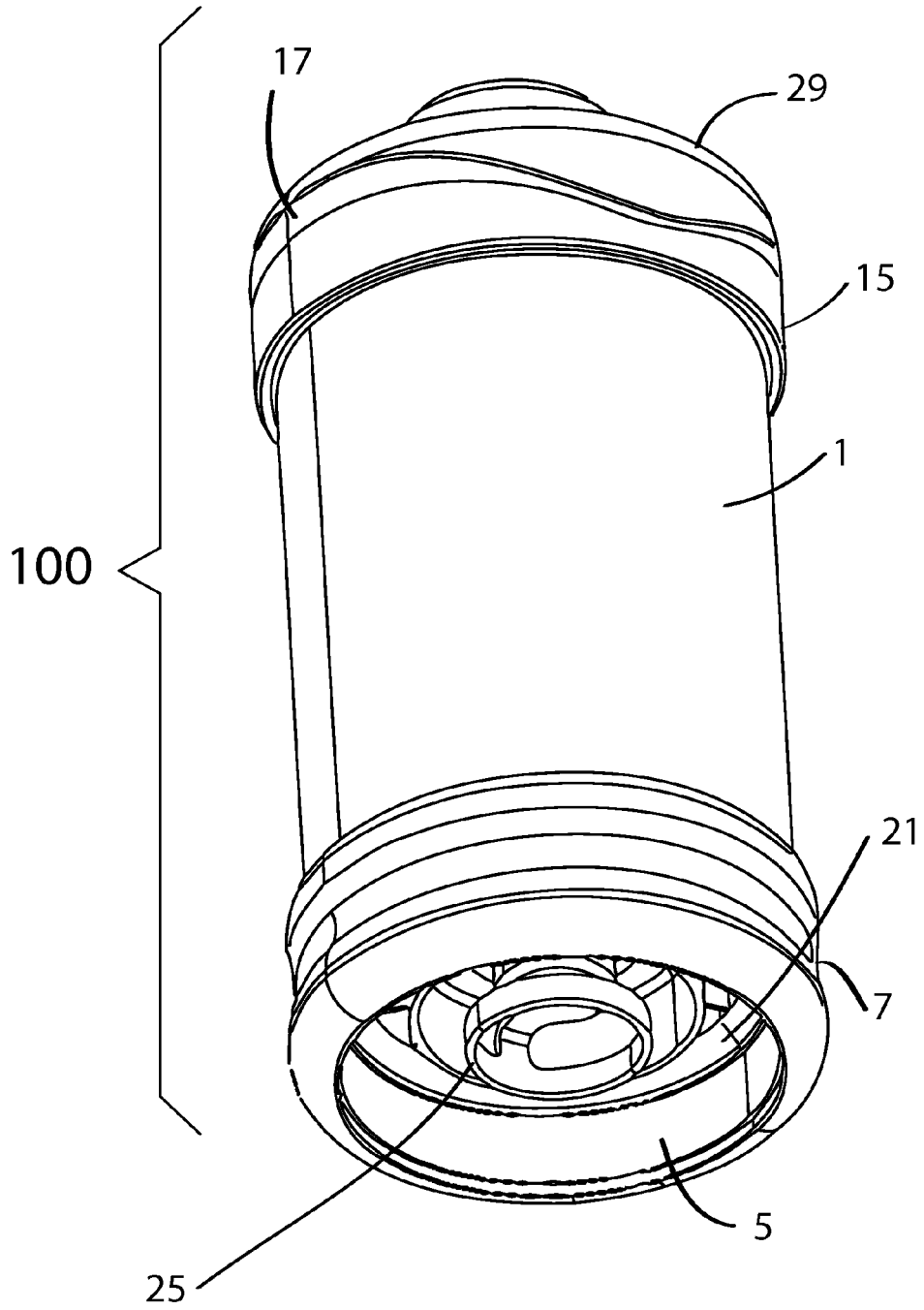
FIG. 4 illustrates a bottom oblique view of the capped, assembled airless container as set forth above.

FIG. 2 illustrates a cut view of the present invention airless baby bottle shown in FIG. 1 and FIG. 3 illustrates a front view of the assembled, capped present invention airless container 100 shown in FIGS. 1 and 2. Both FIGS. 2 and 3 have numbers identical to those of FIG. 1 and show further details of this present invention airless container. FIG. 4 illustrates a bottom oblique view of the capped, assembled airless container 100, showing details of the now inserted piston 21.

Figure 5:
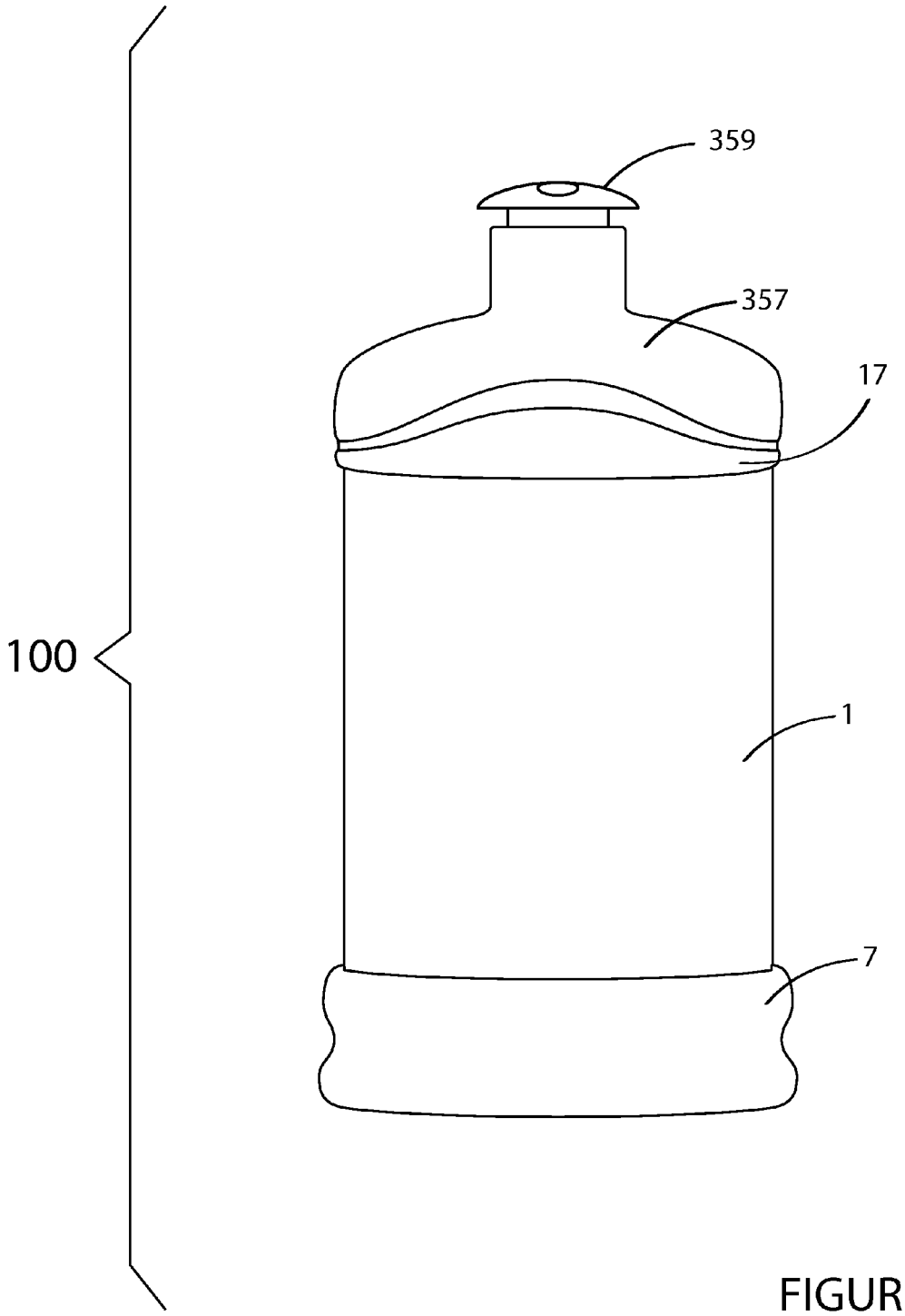
FIG. 5 illustrates a front view of another alternative embodiment airless container of the present invention using a push-pull liquid outlet.
Figure 6:
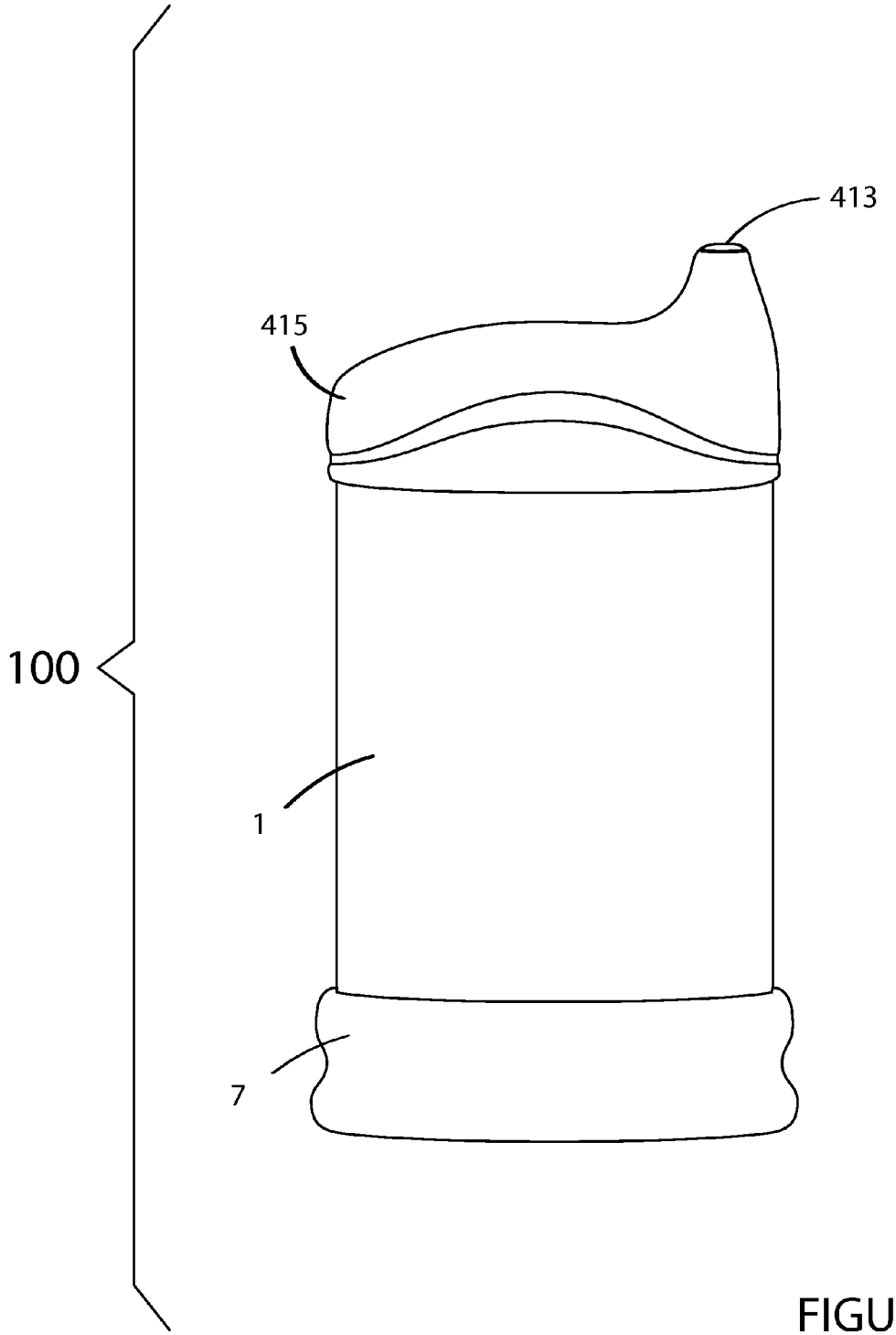
FIG. 6 illustrates a front view of another alternative embodiment airless container of the present invention using a spout liquid outlet.
Figure 7:
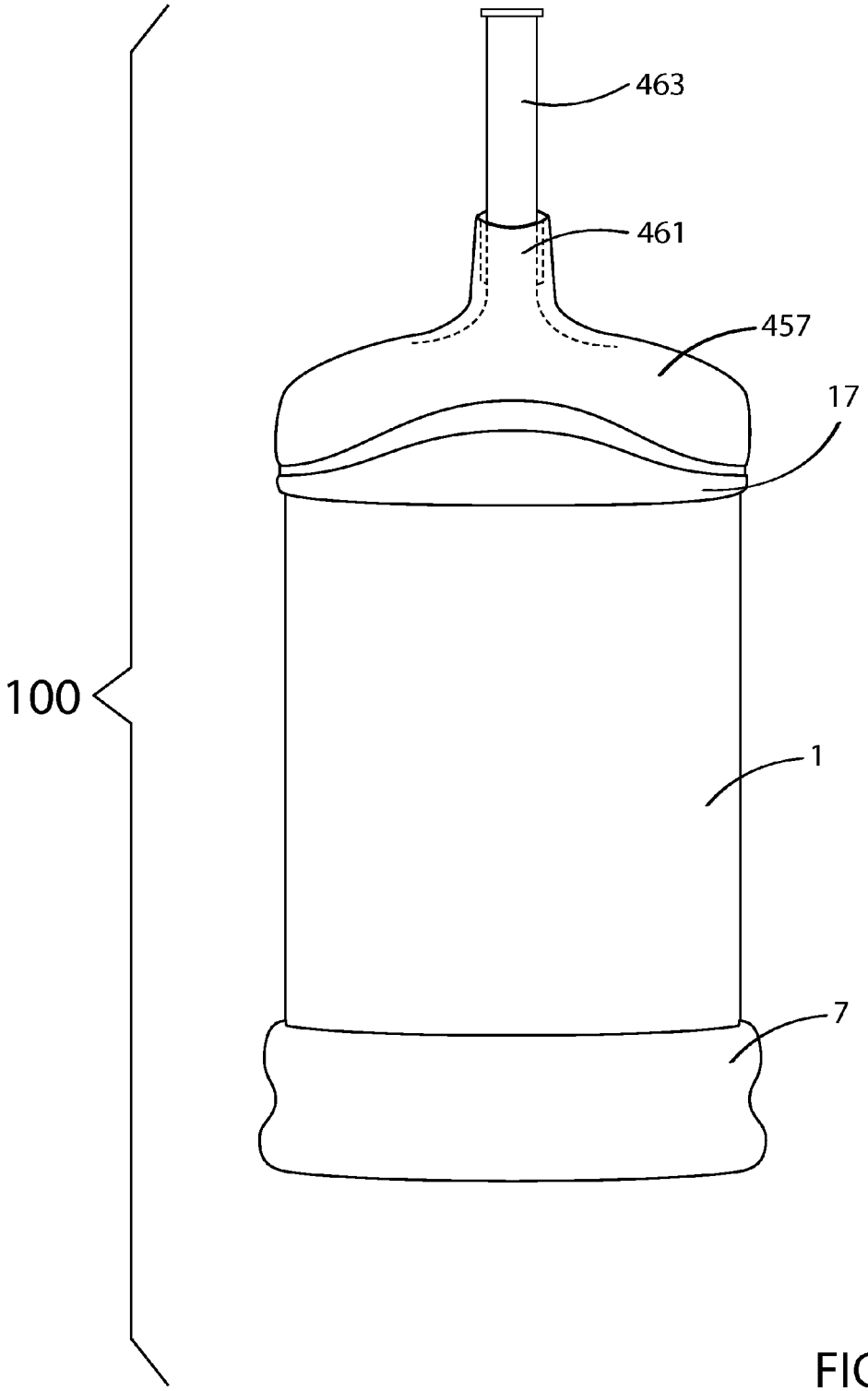
FIG. 7 illustrates a front view of another alternative embodiment airless container of the present invention using a spout and straw liquid outlet.

FIG. 5 illustrates a front view of another alternative embodiment airless container 100 of the present invention using a push-pull liquid outlet 359. There is an elongated shaft 1, a piston (not shown), a grip element 7, a fastening collar 17, and a push-pull cap 357, with push-pull liquid outlet 359. FIG. 6 illustrates a front view of another alternative embodiment airless container 100 of the present invention using a spout liquid outlet 413, located off-center on lid 415. The lid is attached securely shaft 1. And there is a grip 7. Other internal aspects (open top and bottom of shaft, piston, attachment means) are the same or similar to those shown above. A screw cap or snap cap for the spout liquid outlet 413 is not shown, but may be included. FIG. 7 illustrates a front view of another alternative embodiment airless container 100 of the present invention using a spout and straw liquid outlet 461, located on-center on lid 457. The lid is attached securely shaft 1 with threaded collar 17, and there is a grip 7 at the base of shaft 1. Other internal aspects (open top and bottom of shaft, piston, attachment means) are the same or similar to those shown above. The straw 461 extends only into the neck of lid 457 at orifice 459, and a screw cap or snap cap for the straw 461 is not shown, but may be included. It should be understood that piston 21 may be or replace any pistons in all container embodiments. Variations may be implemented without exceeding the scope of the present invention. These include the top peripheral shape, which would be the shape of any container into which it is installed, the handles and dome designs, the number of ridges and the like. The piston may be constructed of preferred materials described above and will generally result in zero leakage over extended use as an important component of the present invention container. This leak-proof result is not obvious or easy to achieve and took years of development. It has been found that the two sets of blades (upper and lower) coupled with the plurality of peripheral ridges, provide upper and lower plural seals and also minimize the coefficient of friction between the piston and the inside of the shaft as the piston moves under the normal suction pressure of a baby, older human being, animal or hand or electrical pumps. All prior art plungers lacking these elements that were available for testing, were found to not be leak-proof.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. An airless container, which comprises:

a container elongated shaft having at least one side wall, an open top and an open bottom;

a piston having a top view footprint outer perimeter consistent with an elongated shaft internal cross-section so as to sealably and moveably fit within said open bottom of said elongated shaft, said piston having external sides with a peripheral upper blade and a peripheral lower blade, each of said peripheral upper blade peripheral lower blade having a plurality of peripheral ridges running perpendicular to said elongated shaft elongation direction, a liquid outlet piece and a fastening collar adapted to be secured to the open top of the container.

2. The airless container of claim 1 wherein at least said peripheral upper blades and peripheral lower blades are composed of a material featuring silicone.

3. The airless container of claim 1 wherein said peripheral upper blades and peripheral lower blades have at least two ridges on each blade.

4. The airless container of claim 1 wherein said shaft further comprises an elastomeric grip component at its bottom.

5. The airless container of claim 1, wherein said peripheral upper blades and peripheral lower blades extend around a body of the piston.

6. The airless container of claim 1, wherein the ridges are flexible angled grooves angled in a direction towards an internal wall of the shaft.

7. The airless container of claim 1, wherein internal ridges are on an opposite side from the ridges and in an angled direction away from internal walls of the shaft.

8. An airless container, which comprises:

a container elongated shaft having at least one side wall, an open top and an open bottom;

a piston having a top view footprint outer perimeter consistent with an elongated shaft internal cross-section so as to sealably and moveably fit within said open bottom of said elongated shaft, said piston having external sides with a peripheral upper blade and a peripheral lower blade, each of said peripheral upper blade peripheral lower blade having a plurality of external and internal peripheral ridges running perpendicular to said elongated shaft elongation direction and extending around a body of the piston.

9. The airless container of claim 8 wherein at least said peripheral upper blades and peripheral lower blades are composed of a material featuring silicone.

10. The airless container of claim 8 wherein said peripheral upper blades and peripheral lower blades have at least two ridges on each blade.

11. An airless container, which comprises:

a container having an elongated shaft;

a piston having a top view footprint outer perimeter consistent with the container, wherein said piston has external sides with a peripheral upper blade and a peripheral lower blade, each of said peripheral upper blade peripheral lower blade having a plurality of external and internal peripheral ridges running perpendicular to an elongated shaft elongation direction.

12. The airless container of claim 11, wherein the ridges are straight and maintain a sealing affect.

* * * * *